US009241213B2

(12) United States Patent
French et al.

(10) Patent No.: US 9,241,213 B2
(45) Date of Patent: Jan. 19, 2016

(54) ACOUSTIC TRANSDUCER

(71) Applicant: HARMAN BECKER GEPKOCSIRENDSZER GYARTO KORLATOLT FELELOSSEGU TARSASAG, Szekesfehervar (HU)

(72) Inventors: John B. French, Caledon East (CA); David Russell, Toronto (CA)

(73) Assignee: Harman Becker Gepkocsirendszer Gyarto Korlatolt Felelossegu Tarsasag, Szekesfehervar (HU)

( * ) Notice: Subject to any disclaimer, the term of this patent is extended or adjusted under 35 U.S.C. 154(b) by 0 days.

(21) Appl. No.: 14/496,769

(22) Filed: Sep. 25, 2014

(65) Prior Publication Data

US 2015/0010198 A1 Jan. 8, 2015

Related U.S. Application Data

(63) Continuation of application No. 13/760,772, filed on Feb. 6, 2013, now abandoned.

(60) Provisional application No. 61/733,018, filed on Dec. 4, 2012, provisional application No. 61/750,470, filed on Jan. 9, 2013.

(51) Int. Cl.
*H04R 25/00* (2006.01)
*H04R 3/00* (2006.01)
(Continued)

(52) U.S. Cl.
CPC .. *H04R 3/00* (2013.01); *H04R 9/00* (2013.01); *H04R 9/06* (2013.01); *H04R 9/025* (2013.01); *H04R 9/046* (2013.01); *H04R 2209/021* (2013.01); *H04R 2209/022* (2013.01)

(58) Field of Classification Search
CPC ..... H04R 9/02; H04R 9/06; H04R 3/00; H04R 3/002; H04R 9/025; H04R 9/046; H04R 2209/022; H04R 9/00; H04R 2209/021
USPC ..... 381/400, 401, 406, 414
See application file for complete search history.

(56) References Cited

U.S. PATENT DOCUMENTS 2,286,123 A 6/1942 Steers
2,770,681 A 11/1956 Perry
(Continued)

FOREIGN PATENT DOCUMENTS

WO 9416536 A1 7/1994

OTHER PUBLICATIONS

International Search Report and Written Opinion for corresponding Application No. PCT/CA2013/000109, mailed May 14, 2013, 7 pages.

(Continued)

*Primary Examiner* — Davetta W Goins
*Assistant Examiner* — Phylesha Dabney
(74) *Attorney, Agent, or Firm* — Brooks Kushman P.C.

(57) ABSTRACT

This invention relates to acoustic transducers with stationary and moving coils, and methods for operating the acoustic transducers. Time varying signals are applied to the moving and stationary coils to control the movement of a diaphragm, which produces sound. The time varying signal applied to the moving coil corresponds to at least a processed version of an input audio signal and is updated based on, at least, a version of the time varying signal applied to the stationary coil. Some embodiments include updating the processed version of the input audio signal in response to a magnetic flux value corresponding to the time-varying signal applied to the stationary coil. Some embodiments include updating the time-varying signal applied to the moving coil in response to a feedback signal.

26 Claims, 7 Drawing Sheets

(51) Int. Cl.

| | |
|---|---|
| ***H04R 9/06*** | (2006.01) |
| ***H04R 9/00*** | (2006.01) |
| *H04R 9/02* | (2006.01) |
| *H04R 9/04* | (2006.01) |

(56) References Cited

U.S. PATENT DOCUMENTS

| | | | |
|---|---|---|---|
| 4,243,839 | A | 1/1981 | Takahashi et al. |
| 5,487,114 | A | 1/1996 | Dinh |
| 5,832,096 | A | 11/1998 | Hall |
| 6,208,742 | B1 | 3/2001 | Garcia et al. |
| 6,639,994 | B1 | 10/2003 | Proni et al. |
| 8,139,816 | B2 | 3/2012 | French et al. |
| 2009/0190794 | A1 | 7/2009 | French et al. |
| 2012/0257782 | A1 | 10/2012 | French et al. |

OTHER PUBLICATIONS

Office Action for corresponding U.S. Appl. No. 13/760,772, mailed Mar. 26, 2014, 15 pages.

ACOUSTIC TRANSDUCER

CROSS-REFERENCE TO RELATED APPLICATIONS

This application is a continuation of U.S. application Ser. No. 13/760,772 filed Feb. 6, 2013, which, in turn, claims the benefit of U.S. provisional application Ser. No. 61/733,018 filed Dec. 4, 2012 and U.S. provisional application Ser. No. 61/750,470 filed Jan. 9, 2013, the disclosures of which are hereby incorporated in their entirety by reference herein.

FIELD

The embodiments described herein relate to acoustic transducers.

BACKGROUND

Many acoustic transducers or drivers use a moving coil dynamic driver to generate sound waves. In most transducer designs, a magnet energizes a magnetic flux within an air gap. The moving coil reacts with magnetic flux in the air gap to move the driver. Initially, an electromagnet was used to create a fixed magnetic flux in the air gap. These electromagnet based drivers suffered from high power consumption. More recently, acoustic drivers have been made with permanent magnets. While permanent magnets do not consume power, they have limited BH products, can be bulky and depending on the magnetic material, they can be expensive. In contrast, the electromagnet based drivers do not suffer from the same BH product limitations.

There is a need for a more efficient electromagnet based acoustic transducer that incorporates the advantages of electromagnets while reducing the effect of some of their disadvantages.

SUMMARY

The embodiments described herein generally relate to acoustic transducers with stationary and moving coils, and methods for operating the acoustic transducers. Time varying signals are applied to the moving and stationary coils to control the movement of a diaphragm, which produces sound. The time varying signal applied to the moving coil can be updated based on, at least, a version of the time varying signal applied to the stationary coil.

In accordance with some embodiments of the invention, there is provided a method of operating an acoustic transducer, the method comprising: receiving an input audio signal; generating a time-varying stationary coil signal in a stationary coil, wherein the time-varying stationary coil signal corresponds to the input audio signal, wherein the stationary coil induces a magnetic flux in a magnetic flux path; generating a time-varying moving coil signal in a moving coil, wherein: the moving coil is disposed within the magnetic flux path; the time-varying moving coil signal corresponds to both the time-varying stationary coil signal and a processed version of the input audio signal; and the time-varying moving coil is coupled to a moving diaphragm which moves in response to the time-varying moving coil signal; and generating the processed version of the input audio signal in response to a magnetic flux value corresponding to the time-varying stationary coil signal. The processed version of the input audio signal may be iteratively updated in response to the magnetic flux value.

In some cases, the acoustic transducer is a hybrid acoustic transducer including a permanent magnet that also generates magnetic flux in the magnetic flux path. In such cases, the time-varying stationary coil signal is generated corresponding to both the magnetic flux induced by the permanent magnet and the input audio signal.

In accordance with another embodiment of the invention, there is provided an acoustic transducer comprising: an audio input terminal for receiving an input audio signal; a driver having: a moving diaphragm; a magnetic material having an air gap; a stationary coil for inducing magnetic flux in the magnetic material and the air gap; a moving coil coupled to the diaphragm wherein the moving coil is disposed at least partially within the air gap; and a control system adapted to: produce a time-varying stationary coil signal in the stationary coil, wherein the time-varying stationary coil signal corresponds to the input audio signal; produce a time-varying moving coil signal in the moving coil, wherein: the time-varying moving coil signal corresponds to both the time-varying stationary coil signal and a processed version of the input audio signal; and the time-varying moving coil is coupled to the moving diaphragm which moves in response to the time-varying moving coil signal; and update the processed version of the input audio signal in response to a magnetic flux value corresponding to the time-varying stationary coil signal.

In accordance with another embodiment of the invention, there is provided a method of operating an acoustic transducer, the method comprising: receiving an input audio signal; generating a time-varying moving coil signal in a moving coil, wherein: the moving coil is disposed within a magnetic flux path; the time-varying moving coil signal corresponds to at least a processed version of the input audio signal; and the moving coil is coupled to a moving diaphragm which moves in response to the time-varying moving coil signal; generating a feedback signal for updating the time-varying moving coil signal; applying a time-varying stationary coil signal in a stationary coil, the stationary coil induces a magnetic flux in the magnetic flux path, the time-varying stationary coil signal corresponds to the feedback signal; and updating the time-varying moving coil signal in response to the feedback signal.

In accordance with another embodiment of the invention, there is provided an acoustic transducer comprising: an audio input terminal for receiving an input audio signal; a driver having: a moving diaphragm; a magnetic material having an air gap; a stationary coil for inducing magnetic flux in the magnetic material and the air gap; a moving coil coupled to the diaphragm wherein the moving coil is disposed at least partially within the air gap; and a control system adapted to: generate a time-varying moving coil signal in the moving coil, wherein: the time-varying moving coil signal corresponds to at least a processed version of the input audio signal; and the moving coil is coupled to the moving diaphragm which moves in response to the time-varying moving coil signal; generate a feedback signal for updating the time-varying moving coil signal; apply a time-varying stationary coil signal in the stationary coil, wherein the time-varying stationary coil signal corresponds to the feedback signal; and update the time-varying moving coil signal in response to the feedback signal.

Additional features of various aspects and embodiments are described below.

BRIEF DESCRIPTION OF THE DRAWINGS

Several embodiments of the present invention will now be described in detail with reference to the drawings, in which.

Various features of the drawings are not drawn to scale in order to illustrate various aspects of the embodiments described below. In the drawings, corresponding elements are, in general, identified with similar or corresponding reference numerals.

DETAILED DESCRIPTION OF EXEMPLARY EMBODIMENTS

Figure 1:
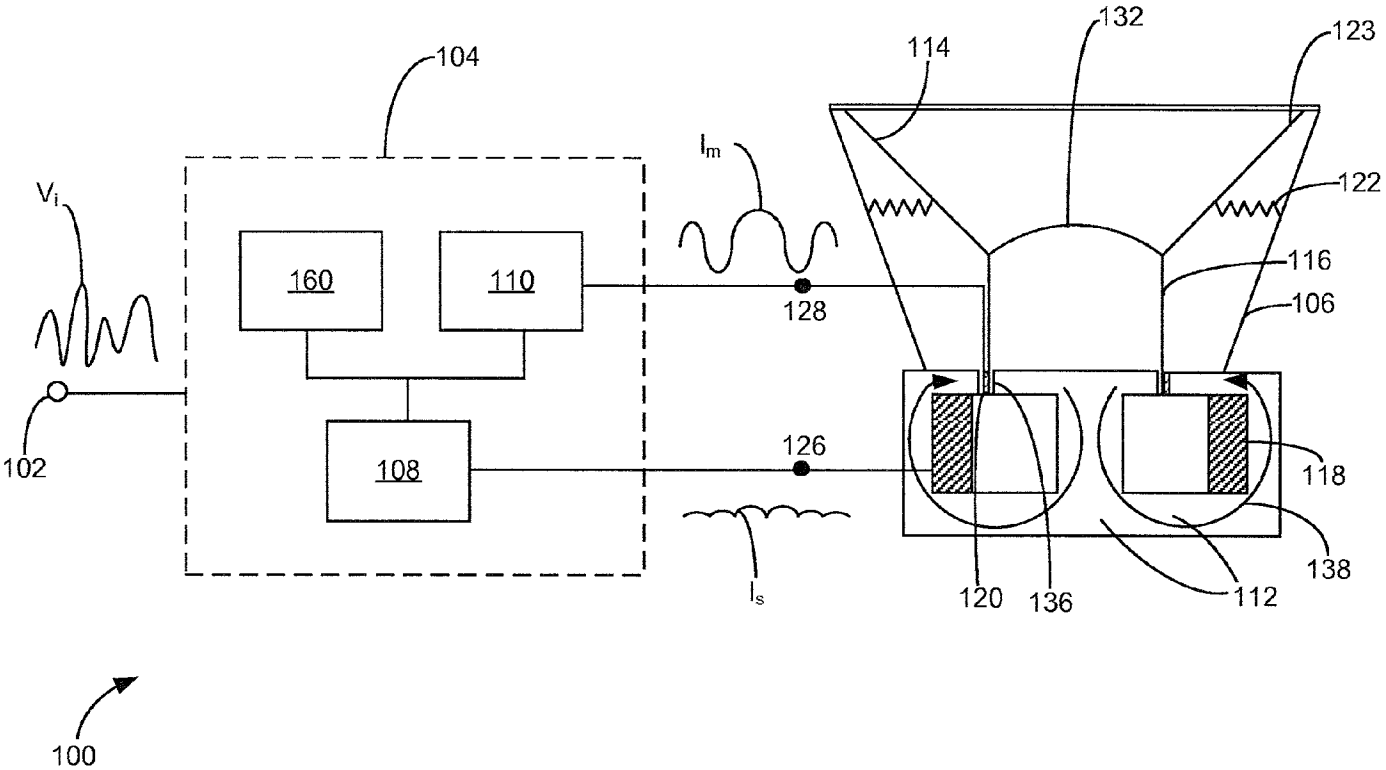
FIG. 1 illustrates an acoustic transducer in accordance with an example embodiment.

Reference is first made to FIG. 1, which illustrates a first embodiment for an acoustic transducer 100. Acoustic transducer 100 has an input terminal 102, a control block 104, and a driver 106. FIG. 1 illustrates driver 106 in cross-section and the remaining parts of acoustic transducer 100 in block diagram form.

Control block 104 includes a stationary coil signal generation block 108, a moving coil signal generation block 110 and a dynamic equalization block 160. As shown in FIG. 1, each of the dynamic equalization block 160, the stationary coil signal generation block 108 and the moving coil signal generation block 110 may be coupled to each other for transmitting and/or receiving data.

In operation, an input audio signal $V_i$ is received at the input terminal 102. The input audio signal $V_i$ may then be transmitted to one or more of the blocks within the control block 104.

In some embodiments, as will be further described below, each of the stationary coil signal generation block 108 and the dynamic equalization block 160 is coupled to the input terminal 102. The input audio signal $V_i$ is transmitted to both the stationary coil signal generation block 108 and the dynamic equalization block 160. Stationary coil signal generation block 108 generates a stationary coil current signal $I_s$ at node 126 in response to the input audio signal $V_i$. The dynamic equalization block 160 generates a processed version of the input audio signal, which is transmitted to the moving coil signal generation block 110. The moving coil signal generation block 110 then generates a moving coil current signal $I_m$ at node 128 in response partially to both the processed version of the input audio signal received from the dynamic equalization block 160 and a stationary coil control signal received from the stationary coil signal generation block 108.

In some other embodiments, as will also be further described below, only the dynamic equalization block 160 is coupled to the input terminal 102. The input audio signal $V_i$ is transmitted to the dynamic equalization block 160. The dynamic equalization block 160 generates a processed version of the input audio signal, which is transmitted to the moving coil signal generation block 110. The moving coil signal generation block 110 then generates a moving coil current signal $I_m$ at node 128 in response to both the processed version of the input audio signal and a stationary coil control signal received from the stationary coil signal generation block 108. The moving coil signal generation block 110 also generates a moving coil control signal, which is provided to the stationary coil signal generation block 108. Based on the moving coil control signal, the stationary coil signal generation block 108 generates a stationary coil current signal $I_s$.

Driver 106 includes magnetic material 112, a diaphragm 114, a moving coil former 116, a stationary coil 118 and a moving coil 120. Driver 106 also includes an optional diaphragm support that includes a spider 122 and a surround 123.

Magnetic material 112 is generally toroidal and has a toroidal cavity. Stationary coil 118 is positioned within the cavity. In various embodiments, magnetic material 112 may be formed from one or more parts, which may allow stationary coil 118 to be inserted or formed within the cavity more easily. Magnetic material 112 is magnetized in response to the stationary coil current signal $I_s$, producing magnetic flux in the magnetic material. Magnetic material has a cylindrical air gap 136 in its magnetic circuit 138 and magnetic flux flows through and near the air gap 136. It will be understood that a path along with the magnetic flux flows may be referred to as a magnetic flux path.

Magnetic material 112 may be formed of any material that is capable of becoming magnetized in the presence of a magnetic field. In various embodiments, magnetic material 112 may be formed from two or more such materials. In some embodiments, the magnetic material 112 may be formed from laminations. In some embodiments, the laminations may be assembled radially and may be wedge shaped so that the composite magnetic material is formed with no gaps between laminations.

Moving coil 120 is mounted on moving coil former 116. Moving coil 120 is coupled to moving coil signal generation block 110 and receives the moving coil current signal $I_m$. Diaphragm 114 is mounted to moving coil former 116 such that diaphragm 114 moves together with moving coil 120 and moving coil former 116. The moving coil 120 and the moving coil former 116 move within air gap 136 in response to the moving coil current signal $I_m$ and the magnetic flux in the air gap 136. Components of acoustic transducers that move with the moving coil former 116 may be referred to as moving components. Components that are stationary when the moving coil former 116 is in motion may be referred to as stationary components. Stationary components of the acoustic transducer 100 include magnetic material 112 and the stationary coil 118.

In various embodiments, the acoustic transducer 100 may be adapted to vent the air space between a dust cap 132 and the magnetic material 112. For example, an aperture may be formed in the magnetic material 112, or apertures may be formed in the moving coil former 116 to allow venting of the air space, thereby reducing or preventing air pressure from affecting the movement of the diaphragm 114.

Control block 104 generates the stationary and moving coil signals in response to the input audio signal $V_i$ such that diaphragm 114 generates audio waves corresponding to the input audio signal $V_i$.

The stationary and moving coil signals correspond to the input audio signal $V_i$ and also correspond to one another. Both of the stationary and moving coil signals respectively, are time-varying signals, in that the magnitude of the stationary and moving coil signals is not fixed at a single magnitude during operation of the acoustic transducer 100. Changes in the stationary coil signal produce different levels of magnetic flux in the magnetic material 112 and the air gap 136. Changes in the moving coil signal cause movement of the diaphragm 114, producing sound corresponding to the input audio signal $V_i$. In some embodiments, the stationary and moving coil signal generation blocks 108 and 110, respectively, are coupled to one another.

In some other embodiments, the moving and stationary coil signal generation blocks 108 and 110, respectively, may not be coupled to one another, but one or both of the moving and stationary coil signal generation blocks 108 and 110, respectively, may be adapted to estimate or model the moving and stationary coil current signals, $I_s$ and $I_m$, respectively, generated by the other block and then generate its own respective coil signal in response to the modeled coil signal and the input audio signal.

In various embodiments of acoustic transducers according to the present invention, the stationary and moving coil generation blocks 108 and 110, respectively, may be adapted to operate in various manners depending on the desired performance and operation for the transducer.

Figure 2:
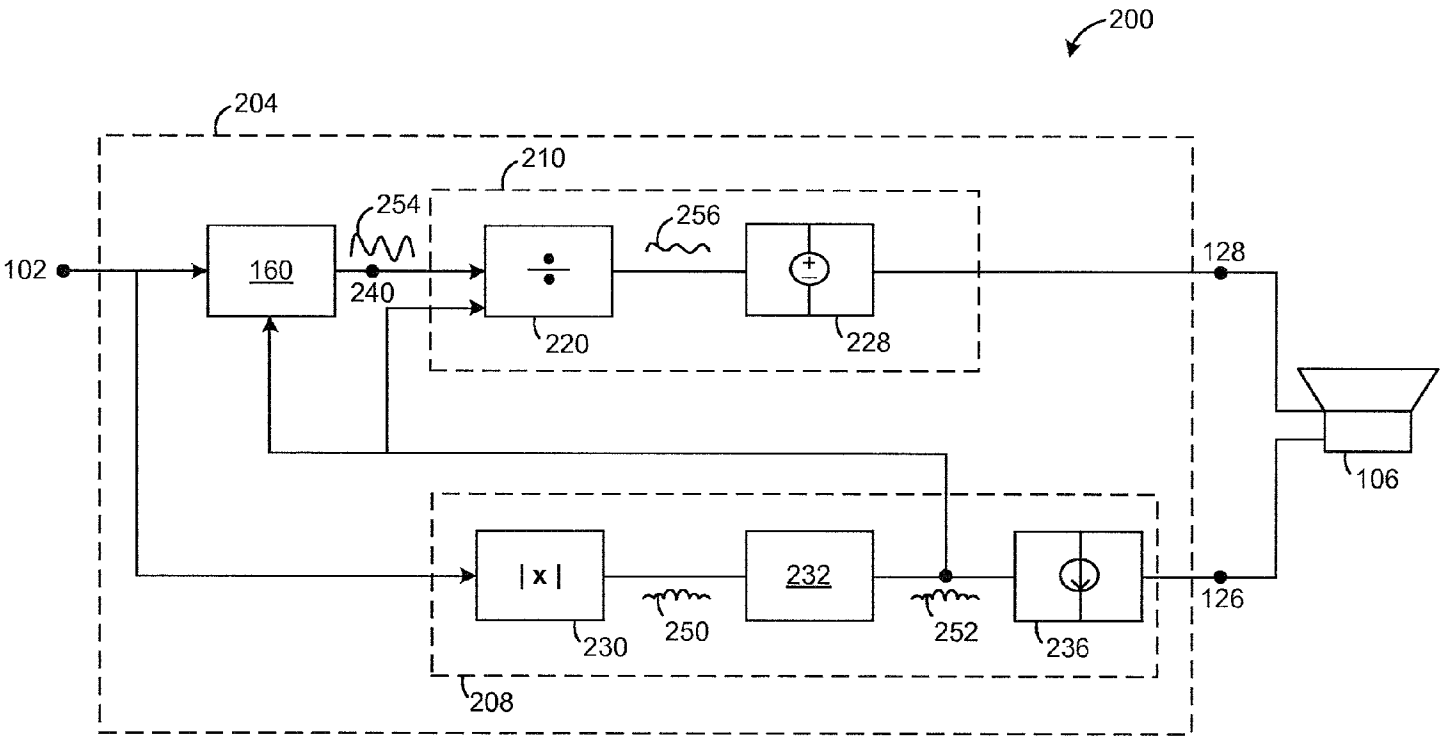
FIGS. 2 to 4 illustrate acoustic transducers in accordance with other example embodiments.

Referring now to FIG. 2, which illustrates control block 204 of a second embodiment of acoustic transducer 200 in greater detail.

The control block 204 includes a stationary coil signal generation block 208 and a moving coil signal generation block 210.

Stationary coil signal generation block 208 includes an absolute value block 230, a stationary coil process block 232 and a stationary coil current regulator 236. Absolute value block 230 receives the input audio signal $V_i$ and provides a rectified input audio signal 250. Using the absolute value of the input audio signal $V_i$ results in the stationary coil signal being a unidirectional signal. In some embodiments, the stationary coil signal can therefore always be a positive signal. Stationary coil process block 232 generates a stationary coil control signal 252 in response to the rectified input audio signal 250.

In different embodiments, stationary coil process block 232 may have various elements and may operate in various manners. Some examples of the stationary coil process block 232 are described in U.S. Pat. No. 8,139,816, which is incorporated herein by this reference. For example, the stationary coil process block 232 may, in some embodiments, include a scaler, a square root block and a limiter block. Alternatively, the stationary coil process block 232 may, in some embodiments, include a RCD peak-hold with a decay network comprising a diode, a capacitor, and a resistor. It will be understood that circuit components may be provided as physical components or as one or more digital modules. It will be further understood that other example embodiments of the stationary coil process block 232 may be used. Stationary coil current regulator 236 generates the stationary coil signal as a current signal in response to the stationary coil control signal 252.

In practice, the useful magnitude of the stationary coil signal is limited. The magnetic material 112 has a saturation flux density that corresponds to a maximum useful magnitude for the stationary coil current signal $I_s$. Increase in the magnitude of the stationary coil current signal $I_s$ beyond this level will not significantly increase the flux density in the air gap 136. The maximum useful magnitude for the stationary coil current signal $I_s$ may be referred to as $I_{s\text{-}max}$.

Moving coil signal generation block 210 includes a divider 220 and a moving coil voltage regulator 228. Divider 220 receives the processed version of the input audio signal 254, as generated by the dynamic equalization block 160, from node 240. Divider 220 divides the processed version of the input audio signal 254 by the stationary coil control signal 252 to generate a moving coil control signal 256. Moving coil voltage regulator 228 generates the moving coil signal as a voltage signal, or a moving coil voltage signal $V_m$, in response to the moving coil control signal 256. The moving coil voltage signal $V_m$ may be derived to generate an appropriate moving coil current signal $I_m$ based on the following equation:

$$I_m = \frac{V_m}{Z_m}, \tag{1}$$

where $Z_m$ corresponds to an impedance at the moving coil 120. In some embodiments, $Z_m$ may be modeled as a resistor.

Unlike a current signal generated by a current source, the moving coil current signal $I_m$ derived from the moving coil voltage signal $V_m$ may benefit by being appropriately controlled to minimize the effect of the impedance of the moving components at the moving coil 120. The moving coil voltage regulator 228 operates as a voltage source power amplifier that receives an input audio signal and generates an appropriate voltage signal from that input audio signal.

Referring still to FIG. 2, the stationary coil signal is provided as a current signal whereas the moving coil current signal $I_m$ may be generated from the moving coil voltage signal $V_m$. As the stationary coil signal is provided as a current signal and the stationary coil 118 is coupled to the moving coil 120, the voltage reflected from the moving coil 118 to the stationary coil 120 may cause the signals generated from the stationary coil current regulator 236 to clip. One solution for minimizing the reflected voltage can be to wind a bucking coil physically adjacent the stationary coil 118 and in series with the moving coil 120 but in opposite phase to the moving coil 120. However, the effects of the bucking coil are frequency-dependent and therefore, may not always cancel the reflected voltage on the stationary coil 118. Also, use of the bucking coil can be expensive.

Diaphragm 114 changes positions (in fixed relation to the movement of the moving coil 120) in relation to the moving coil signal and the stationary coil signal. At any point in time, the magnetic flux in air gap 136 will be generally proportional to the stationary coil current signal $I_s$ (assuming that the stationary coil signal magnitude is not changing too rapidly). Assuming that the stationary coil current signal $I_s$ is constant, the diaphragm 114 will move in proportion to changes in the moving coil current signal $I_m$ and will produce a specific audio output. If the stationary coil current signal $I_s$ is time-varying, the moving coil current signal $I_m$ must be modified to accommodate for variations in the magnetic flux in the air gap 136 in order to produce the same audio output. The dynamic equalization block 160 operates to compensate for changes in the magnetic flux B in the air gap 136.

As briefly described above, the dynamic equalization block 160 receives and processes the input audio signal $V_i$ for generating the processed version of the input audio signal 254. By using the moving coil voltage regulator 228 instead of a current regulator, the control block 204 may include the dynamic equalization block 160 to compensate for the effects of the electrical components of the moving coil 120. The effects may include back electromotive force (emf) and may be generated by an inductance of the moving coil 120 and/or resistance of the moving coil 120. Generally, a current regulator operates to generate a predetermined current signal and is unaffected by back emf or effects of the inductance and/or resistance of the moving coil 120. Instead, the current signal generated by the current regulator generally only considers the mechanical and acoustic effects of the acoustic transducer 300.

Dynamic equalization block 160 generates the processed version of the input audio signal 254 based partially on the stationary coil control signal 252. The stationary coil control signal 252 is generally proportional to the magnetic flux B in the air gap 136. Accordingly, the dynamic equalization block 160 operates to compensate for changes in the magnetic flux in the air gap 136. That is, the dynamic equalization block 160 provides a forward correction of the moving coil voltage signal $V_m$ based on the magnetic flux of the air gap 136, as determined from the stationary coil control signal 252. An example embodiment of dynamic equalization block 160 is described below with reference to FIG. 7.

Figure 3:
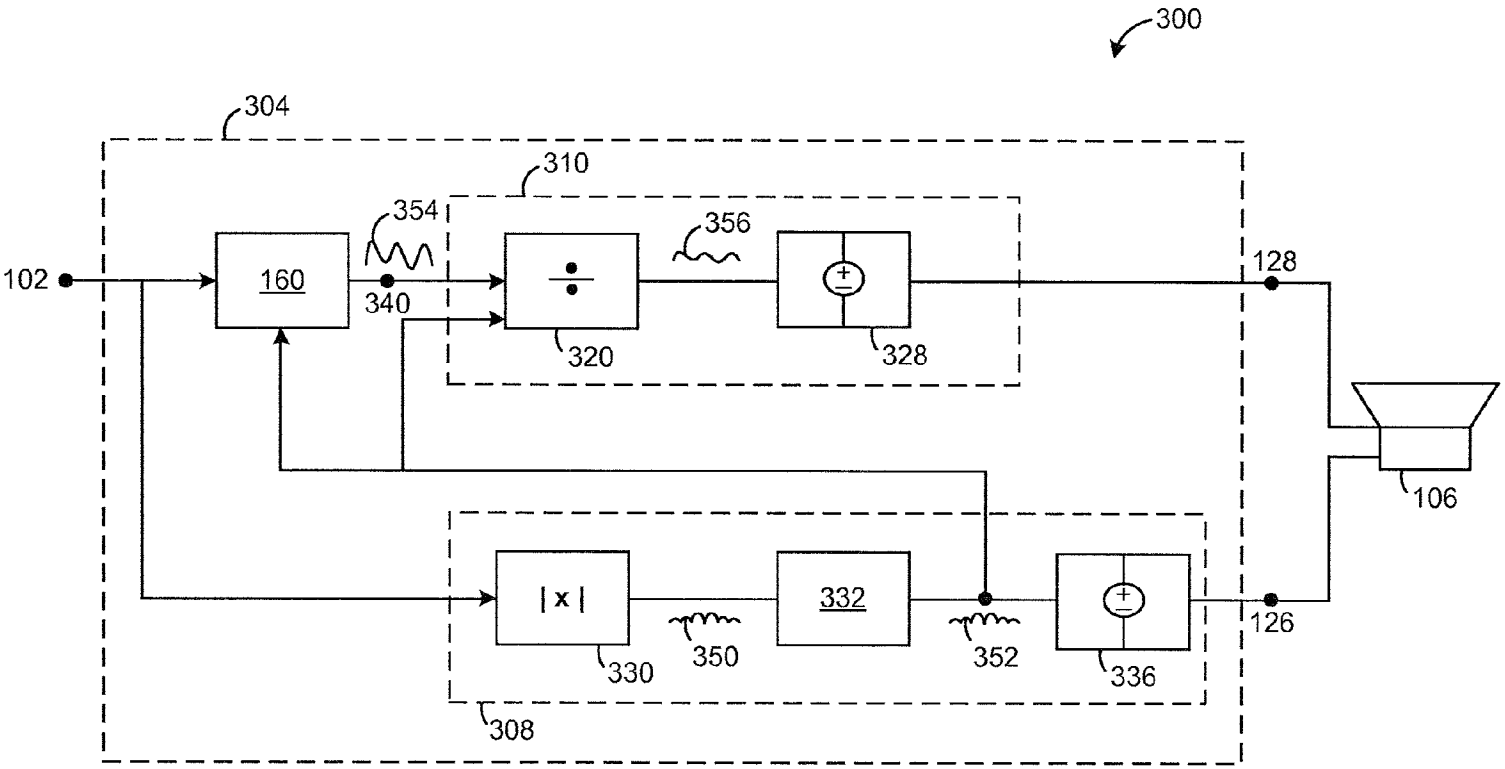

Reference is now made to FIG. 3, which illustrates control block 304 of a third embodiment of acoustic transducer 300 in greater detail.

Acoustic transducer 300 includes a stationary coil signal generation block 308 and a moving coil signal generation block 310. Similar to moving coil signal generation block 210, moving coil signal generation block 310 also includes a divider 320 and a moving coil voltage regulator 328 that operate similarly to divider 220 and moving coil voltage regulator 228.

Stationary coil signal generation block 308 includes an absolute value block 330, a stationary coil process block 332 and a stationary coil voltage regulator 336. Absolute value block 330 receives the input audio signal $V_i$ and provides a rectified input audio signal 350. Stationary coil process block 332 generates a stationary coil control signal 352 in response to the rectified input audio signal 350. Unlike stationary coil current regulator 236 of acoustic transducer 200, stationary coil voltage regulator 336 generates the stationary coil signal as a voltage signal, or a stationary coil voltage signal $V_s$, in response to the stationary coil control signal 352. The stationary coil voltage signal $V_s$ may be converted into a stationary coil current signal $I_s$ using the following equation:

$$I_S = \frac{V_S}{Z_S}, \tag{2}$$

where $Z_s$ corresponds to an impedance at the stationary coil 118. In some embodiments, $Z_s$ may be modeled as a resistor.

As illustrated in FIGS. 2 and 3, the stationary coil signal generation block 208, 308 may include a current regulator or a voltage regulator. As described above, a voltage regulator may be used because it can be easier to implement since, unlike a current regulator, the voltage regulator does not require generation of bi-directional voltage.

Use of the stationary coil voltage regulator 336 may cause problems in the acoustic transducer 300. For example, the stationary coil voltage regulator 336 may lower the efficiency of the acoustic transducer 300 since the stationary coil voltage regulator 336 shunts the current in the stationary coil 118 that is reflected from the current in the moving coil 120. The stationary coil voltage regulator 336 is also frequency dependent and thus, may introduce distortion. However, practically, these problems are minor since the stationary coil 118 is poorly coupled to the moving coil 120 and can be further mitigated with the application of practical geometries in the magnetic material 112 and/or air gap 136.

Figure 4:
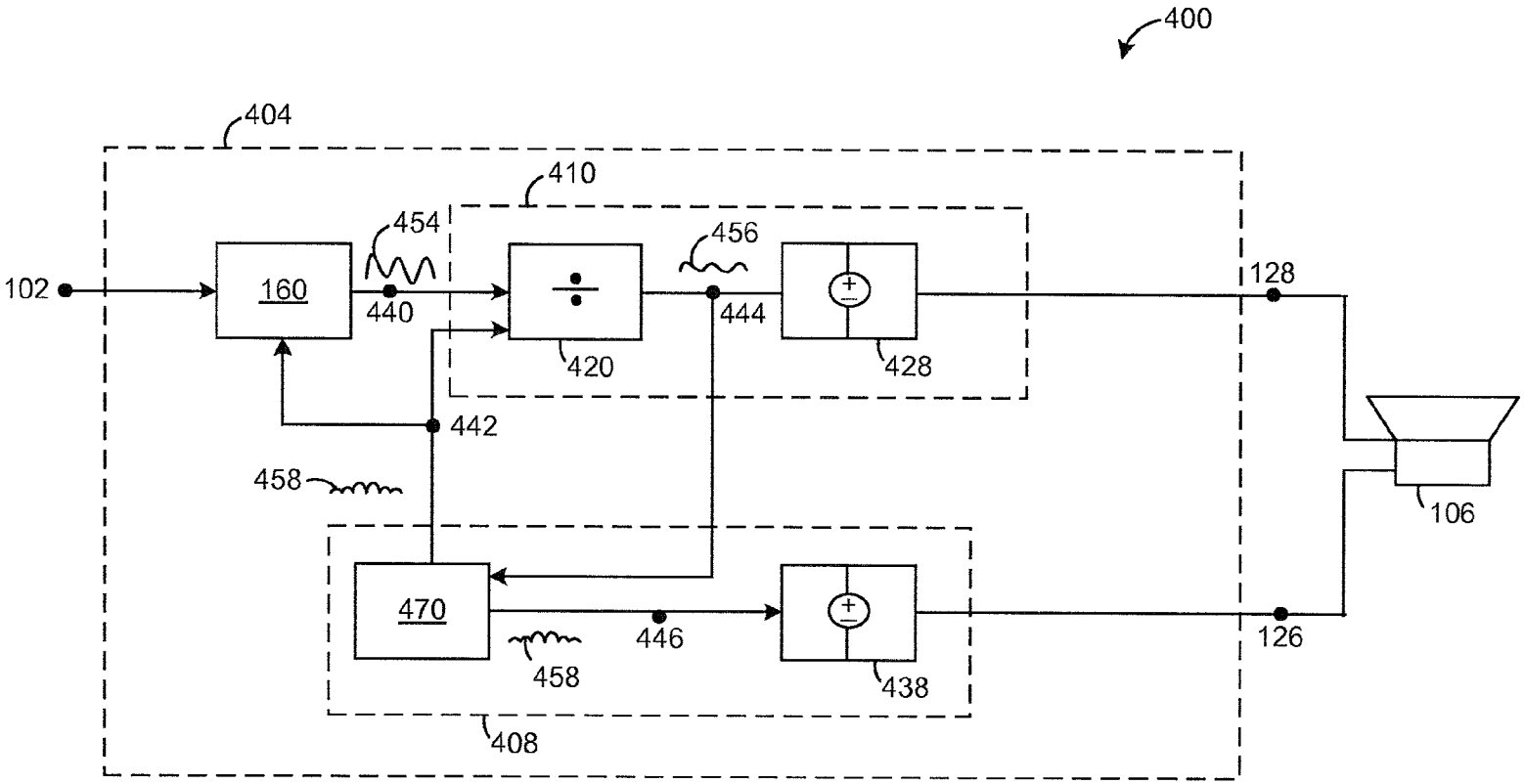

Reference is now made to FIG. 4, which illustrates control block 404 of a fourth embodiment of acoustic transducer 400 in greater detail.

Acoustic transducer 400 includes a stationary coil signal generation block 408 and a moving coil signal generation block 410. Unlike acoustic transducers 200 and 300, however, acoustic transducer 400 operates based on feedback. As will be described below, the stationary coil signal generation block 408 is not coupled to the input terminal 102. Instead, the stationary coil signal generation block 408 includes a feedback block 470 for determining a stationary coil current signal 458, and/or a version of the stationary coil current signal. The determined stationary coil current signal 458, or a version of the determined stationary coil current signal, is then provided to the dynamic equalization block 160 for varying the moving coil signal accordingly. It will be understood that the stationary coil current signal 458 is generally proportional to a magnetic flux at air gap 136

In some embodiments, the acoustic transducer 400 may be provided without the dynamic equalization block 160. For example, the moving coil signal generation block 410 may be coupled to the input terminal 102 for receiving the input audio signal $V_i$ and may also be coupled to the feedback block 470 for receiving the stationary coil current signal 458. In some embodiments, the moving coil voltage regulator 428 may instead be a moving coil current regulator. In some embodiments, the stationary coil voltage regulator 438 may instead by a stationary coil current regulator.

The feedback block 470 may operate to determine the stationary coil current signal 458 for varying the moving coil signal as to control the operating characteristics of the acoustic transducer 400. For example, the stationary coil current signal 458 may be determined for optimizing operations of the acoustic transducer 400, such as by minimizing combined loss at each of the stationary coil 118 and the moving coil 120, reducing clipping of the moving coil current signal $I_m$, regulating a temperature of the moving coil 120, minimizing noise and/or distortion in the acoustic transducer 400. It will be understood that other operating characteristics of the acoustic transducer 400 may similarly be varied using the stationary coil current signal 458.

Similar to moving coil signal generation blocks 210 and 310, moving coil signal generation block 410 also includes a divider 420 and a moving coil voltage regulator 428. Divider 420 generates a moving coil control signal 456 by dividing a processed version of the input audio signal 454 (as received from the dynamic equalization block 160) by the stationary coil current signal 458 (as received from the stationary coil generation block 408). Moving coil voltage regulator 428 generates the moving coil signal as a voltage signal, or a moving coil voltage signal $V_m$, in response to the moving coil control signal 456. The moving coil signal $V_m$ may be converted into a moving coil current signal $I_m$ using Equation (1) above.

In some embodiments, a compressor block may be provided in the moving coil signal generation block 410 for reducing an amplitude of the moving coil control signal 456 to mitigate clipping of the moving coil signal $V_m$ generated by the moving coil voltage regulator 428. For example, the compressor block may be provided in the moving coil signal generation block 410 before the moving coil voltage regulator 428 but generally after node 444. At this position, when the compressor block is in operation, the compressor block may have the effect of increasing the stationary coil current signal 458 since a signal provided to the feedback block 470 from node 444 would be larger than a signal provided by the compressor to the moving coil voltage regulator 428. Also, when the larger stationary coil current signal 458 is provided to the divider 420, the resulting moving coil voltage signal $V_m$ would be decreased by the operation of the divider 420.

Alternatively, the compressor block may be provided in the moving coil signal generation block 410 before the moving coil voltage regulator 428 and generally before node 444. At this position, when the compressor block is in operation, the compressor block may operate to balance power consumed at the stationary coil 118 and the moving coil 120 and as a result, also minimize combined losses at the stationary coil 118 and the moving coil 120. However, when the compressor block is placed at this position, the moving coil voltage signal $V_m$ generated by the moving coil voltage regulator 428 would clip more frequently.

In some embodiments, the determined stationary coil current signal 458 may be increased. For example, the determined stationary coil current signal 458 may be increased for mitigating clipping of the moving coil voltage signal $V_m$ or for mitigating compression when the compressor block is in operation. For increasing the determined stationary coil current signal 458, an RCD peak-hold with a decay network comprising a diode, a capacitor, and a resistor may be charged when the moving coil voltage signal $V_m$ is clipped or when compression caused by the compressor block needs to be mitigated. The output signal of the RCD peak-hold may be added to the determined stationary coil current signal 458. As described above, it will be understood that circuit components may be provided as physical components or as one or more digital modules.

Stationary coil generation block 408 includes the feedback block 470 and the stationary coil voltage regulator 438. Feedback block 470 generates a stationary coil current signal 458 in response to the moving coil control signal 456 generated by divider 420. The stationary coil current signal 458 is provided to the dynamic equalization block 160 and the moving coil signal generation block 410. Feedback block 470 also provides the stationary coil current signal 458, or a version of the stationary coil current signal 458, to the stationary coil voltage regulator 438. The stationary coil voltage regulator 438 generates a voltage signal, or a stationary coil voltage signal $V_s$, in response to the stationary coil current signal 458.

In some embodiments, the feedback block 470 provides the same version of the stationary coil current signal 458 to the dynamic equalization block 160 and the moving coil signal generation block 410, and the stationary coil voltage regulator 438.

In some embodiments, a delay block may be included between the dynamic equalization block 160 and the moving coil signal generation block 410. The delay block may be included in order to provide sufficient response time for the feedback block 470.

Figure 5:
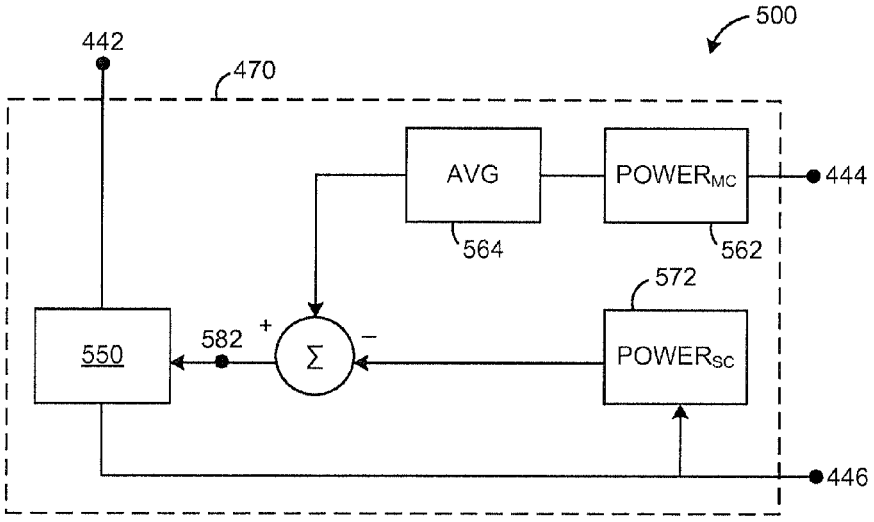
FIG. 5 is a block diagram of a feedback block in accordance with an example embodiment.

Referring now to FIG. 5, which illustrates a block diagram 500 of an example feedback block 470.

As described above, the feedback block 470 may operate to determine the stationary coil current signal 458 for different purposes. The example feedback block 470 illustrated in FIG. 5 operates to determine a stationary coil current signal 458 for minimizing loss at the stationary and moving coils 118 and 120, respectively. The feedback block 470 includes a moving coil power block 562, an optional moving coil average block 564, a stationary coil power block 572 and a balancing block 550.

In some embodiments, the balancing block 550 may be provided as physical circuitry components or one or more digital modules. In some other embodiments, the balancing block 550 may simply be a node within the feedback block 470.

The moving coil power block 562 operates to determine a loss caused by impedance at the moving coil 120, as determined using the following formula:

$$Power_m = \left(\frac{V_m}{Z_m}\right)^2 \times R_m, \tag{3}$$

where $Z_m$ represents the impedance of the moving coil 120 and $R_m$ represents a resistance of the moving coil 120. Similarly, the stationary coil power block 572 operates to determine a loss caused by impedance at the stationary coil 118, as determined using the following formula:

$$Power_s = \left(\frac{V_s}{Z_s}\right)^2 \times R_s, \tag{4}$$

where $Z_s$ represents the impedance of the stationary coil 118 and $R_s$ represents a resistance of the stationary coil 118.

It will be understood that the impedance of the moving coil 120 may be modeled in the s-domain. For example, the impedance of the moving coil 120 for a closed box system may be expressed as:

$$Z_m(s) = R_m + R_{ES}\left[\frac{s \cdot \frac{\tau_{AT}}{Q_{MS}}}{s^2 \cdot \tau_{AT}^2 + s \cdot \frac{\tau_{AT}}{Q_{MS}} + 1}\right], \tag{5}$$

where $R_{ES}$ represents a mechanical resistance as reflected at the electrical side, $Q_{MS}$ represents a damping of the driver 106 at resonance accounting only for mechanical losses, and $\tau_{AT}$ represents a resonance time constant. An inverse of Equation (5) may be expressed as:

$$Z_{m,inverse}(s) = \frac{s^2 \cdot \tau_{AT} + s \cdot \frac{\tau_{AT}}{Q_{MS}} + 1}{s^2 \cdot \tau_{AT}^2 \cdot R_m + s \cdot \frac{\tau_{AT} \cdot (R_{ES} + R_m)}{Q_{MS}} + R_m}. \tag{6}$$

It should be understood that $R_{ES}$ varies with the magnetic flux B in the air gap 136 and may be expressed as:

$$R_{ES} = \frac{Bl_{effective}^2}{S_D^2 \cdot R_{AS}}, \tag{7}$$

where $S_D$ represents a surface area of the diaphragm 114, $R_{AS}$ represents an acoustic resistance of suspension losses, and $l_{effective}$ represents an effective length of the moving coil 120 in the magnetic flux in the air gap 136.

It will be understood that for speakers of other designs, such as vented, bandpass or with a passive radiator the corresponding equation may be used to represent the impedance of the moving coil 120, which will be known to skilled persons.

A bilinear transform may be applied to Equation (6) to generate a biquadratic polynomial in the z-domain, as shown as Equation (8) below as an example, so that the inverse of the impedance of the moving coil 120 may be simulated in the discrete time domain.

$$Z_{m,inverse}(s) = \frac{a_0 + a_1 \cdot z^{-1} + a_2 \cdot z^{-2}}{b_0 + b_1 \cdot z^{-1} + b_2 \cdot z^{-2}}, \quad (8)$$

where $a_0$ and $b_0$ represent coefficients for a current iteration, $a_1$ and $b_1$ represent coefficients for a previous iteration, and $a_2$ and $b_2$ represent coefficients for an iteration prior to the previous iteration. Some of the coefficients in Equation (8) will depend on the magnetic flux B because, as seen from Equation (7), the value of $R_{ES}$ depends on the magnetic flux B. It will be understood that since the magnetic flux B in the air gap 136 changes with each iteration, the coefficients in Equation (8) need to be determined with each iteration. Using the coefficients determined at each iteration, the impedance of the moving coil 120 may be determined and the loss at the moving coil 120 may then also be determined using Equation (3). In some embodiments, the coefficients may be determined from a lookup table or calculated directly from the bilinear transform. In other embodiments, other appropriate equations of similar form may be used.

After determining the losses caused by the impedance at the stationary and moving coils 118 and 120, respectively, it may be desirable to reduce the losses in the stationary and moving coils 118 and 120, respectively. A power balancing signal may be generated, for example at node 582, by subtracting the stationary coil loss ($Power_s$) from the moving coil loss ($Power_m$). Since the minimum loss is when the loss at each of the stationary coil 118 and the moving coil 120 are equal, the balancing block 550 may determine a stationary coil current signal 458 that can minimize loss and to provide the stationary coil current signal 458, or a version of the stationary coil current signal 458, to the stationary coil voltage regulator 438. An example embodiment of the balancing block 550 is further described below with reference to FIG. 6.

In some embodiments, a feedback gain amplifier block may be included at node 582 for amplifying the power balance signal.

In some embodiments, each of the stationary coil power block 572 and the moving coil power block 562 can also be designed to consider the effects of environmental factors. For example, the environmental factors may include surrounding temperature. $R_m$ and $R_s$ will typically be dependent on the temperatures of the stationary and moving coil 118 and 120, respectively. In some embodiments, the temperatures may be measured or estimated, and resistances corresponding to the measured or estimated temperatures may be used to calculate the power balancing signal.

The optional moving coil average block 564 may be included to stabilize the moving coil control signal 456 received from node 444. The moving coil power block 562 generates an instantaneous moving coil power signal that is proportional to a square of a value of the moving coil control signal 456, and the moving coil power signal generated by the moving coil power block 562 is partially used for determining a stationary coil current signal 458. That stationary coil current signal 458 is then provided to, at least, the divider 420 and the dynamic equalization block 160 for updating the moving coil signal. Accordingly, due to the instantaneous moving coil power signal, distortions may be introduced into the updated moving coil control signal 456. By providing the moving coil average block 564, the moving coil power signal may be stabilized by removing distortion components within the audio band of the moving coil control signal 456. Generally, the moving coil average block 564 may operate at low frequency values. For example, the low frequency values may be outside a desired audio frequency band but the low frequency values should allow for a dynamic balancing of the moving coil loss and the stationary coil loss.

In some embodiments, an amplifier loss block may be provided after the moving coil power block 562 for determining a loss at the amplifier. The loss at the amplifier is directly related to the moving coil signal. By including the amplifier loss into the average moving coil loss as determined at the moving coil average block 564, a minimum total system loss can be determined for the acoustic transducer 400.

It will be understood that other configurations and/or designs of the feedback block 470 may be provided. For example, the configurations of the feedback block 470 may vary according to the different purposes for which the stationary coil current signal 458 is determined.

Figure 6:
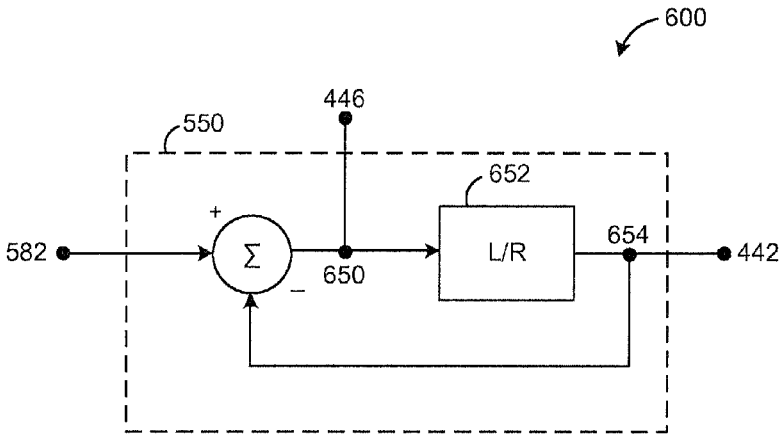
FIG. 6 is a block diagram of a balancing block in accordance with an example embodiment.

Reference is now made to FIG. 6, which illustrates a block diagram 600 of an example balancing block 550.

In some embodiments, the balancing block 550 may be provided as a node within the feedback block 470. Accordingly, the power balancing signal generated at node 582 may be used as the stationary coil current signal 458, and may be provided to the dynamic equalization block 160, divider 420 and the stationary coil voltage regulator 438.

In some other embodiments, the balancing block 550 may be provided with physical circuitry components. In the example balancing block 550 of FIG. 6, for example, the balancing block 550 generates the stationary coil current signal 458, or a version of the stationary coil current signal 458, in response to the power balancing signal received from node 582.

Referring still to FIG. 6, as illustrated, a first version of the stationary coil current signal may be generated at node 650 based on the power balancing signal received from node 582 and a balancing feedback signal from node 654. The balancing feedback signal, provided at node 654, generally corresponds to a previous iteration of the stationary coil current signal 458. At node 650, the first version of the stationary coil current signal 458 is generated by subtracting the balancing feedback signal from the power balancing signal received from node 582. As shown in FIG. 5, the first version of the stationary coil current signal 458 is provided to the stationary coil power block 572 and to the stationary coil voltage regulator 438 via node 446. The stationary coil power block 572 may determine a loss generated at the stationary coil 118 when the first version of the stationary coil current signal is provided to the stationary coil voltage regulator 438.

The balancing block 550 also includes a stationary coil impedance model 652 for generating a second version of the stationary coil current signal 458. The stationary coil impedance model 652 corresponds to a model of the stationary coil 118. The stationary coil impedance model 652 receives the first version of the stationary coil current signal from node 650 and generates the second version of the stationary coil current signal. The second version of the stationary coil current may correspond to the stationary coil signal generated by the stationary coil voltage regulator 438. The second version of the stationary coil current signal 458 may then be provided to the dynamic equalization block 160 and the divider 420 via node 442.

In some embodiments, the stationary coil impedance model 652 may be a first order low pass filter. In some other embodiments, the stationary coil impedance model 652 may be modeled as an inductance. Generally, inductance components operate slowly and therefore, a slow operating moving coil average block 564 would not impair the operation of the feedback block 470.

In some embodiments, the first version and the second version of the stationary coil current signal may be the same.

In some other embodiments, the first version of the stationary coil current signal may instead be provided to node 442, and the second version of the stationary coil current signal may instead be provided to node 446 and the stationary coil power block 572.

In some embodiments, a feedback gain amplifier block may be included before the stationary coil impedance model 652 for amplifying the version of the power balancing signal provided at node 650. By amplifying the power balancing signal, a better balancing of the moving coil loss and the stationary coil loss can be achieved.

Figure 7:
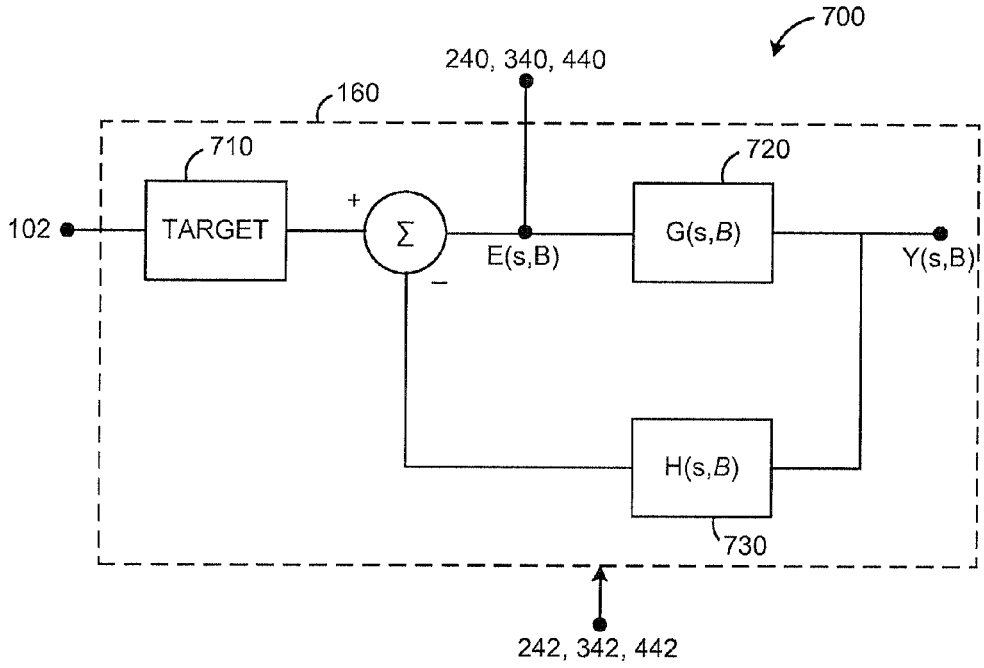
FIG. 7 is a block diagram of a dynamic equalization block in accordance with an example embodiment.

With reference now to FIG. 7, which illustrates a block diagram 700 of an example dynamic equalization block 160.

The dynamic equalization block 160 may include a target signal block 710, a transfer function block 720 and a stabilizing block 730.

The target signal block 710 provides a target input audio signal in response to the input audio signal $V_i$. Generally, the target signal block 710 may vary with operational characteristics of any of the described acoustic transducers in order to provide versions of the input audio signal that are more suited for a particular acoustic transducer. For example, the target signal block 710 may be a high pass filter in order to reduce the amount of low frequency information that the driver 106 may try to reproduce. The high pass filter may be a first, second, or higher, order filter operating within the z-domain, or may even be an analog filter.

The transfer function block 720 includes a model of the stationary coil 118 and is, therefore, a function of the magnetic flux B of the air gap 136. The transfer function block 720 may therefore correspond to a transfer function G(s,B). As described above, the magnetic flux of the air gap 136 is generally proportional to the stationary coil control signal 252, 352, and the stationary coil current signal 458 as received from the stationary coil generation block 208, 308, 408. In some embodiments, it may be assumed that the stationary coil control signal 252, 352, and the stationary coil current signal 458 is directly proportional to the magnetic flux. In some embodiments, the transfer function block 720 may also include models that consider the effects of environmental factors. For example, the environmental factors may include surrounding temperature.

In some embodiments, a flux conversion block may be included between the dynamic equalization block 160 and the stationary coil signal generation block 208, 308, or 408 for associating the stationary coil control signal 252, 352, and the stationary coil current signal 458 with a corresponding magnetic flux value. For example, the flux conversion block may include a lookup table that includes corresponding magnetic flux values for a range of stationary coil control signals 252, 352 or the stationary coil current signal 458.

The stabilizing block 730 operates to stabilize an output signal, Y(s,B), generated by the transfer function block 720. In some embodiments, the stabilizing block 730 may also be a function of the magnetic flux of the air gap 136 because the operation of the transfer function block 720, namely G(s,B), is also a function of the magnetic flux of the air gap 136.

Accordingly, an error signal E(s,B) may be determined by applying the transfer function G(s,B) to the target input audio signal, or T. The error signal E(s,B) is provided to the moving coil signal generation block 210, 310, or 410 at the respective nodes 240, 340 and 440, as the processed version of the input audio signal 254, 354 or 454. The relationships for the dynamic equalization block 160 are provided below:

$$Y(s,B)=E(s,B)\times G(s,B), \tag{9}$$

$$E(s,B)=T-[H(s,B)\times Y(s,B)], \tag{10}$$

Based on Equations (9) and (10), it can be determined that Y(s,B) may be defined as:

$$Y(s,B)=\frac{G(s,B)}{1+G(s,B)H(s,B)}T. \tag{11}$$

In a closed loop system such as the dynamic equalization block 160 illustrated in FIG. 7, the error signal E(s,B) may be determined from the following equation:

$$E(s,B)=\frac{Y(s,B)}{G(s,B)}\approx\frac{T}{G(s,B)}. \tag{12}$$

In some embodiments, any of the described acoustic transducers may be modeled using the s-domain. For example, the target input audio signal T may be a second order high pass filter and may be expressed in the s-domain with the following equation:

$$T(s)=\frac{S^2}{S^2+\frac{s}{Q_{hp}\cdot T_{hp}}+\frac{1}{T_{hp}^2}}, \tag{13}$$

where $Q_{hp}$ represents a damping of the second order high pass filter's damping and $T_{hp}$ represents a time constant of the second order high pass filter.

Also, the transfer function G(s,B) for a closed box system may be expressed in the s-domain with the following equation:

$$G(s,B)=\frac{S^2}{S\cdot\frac{1}{Q(B)_{ts}\cdot T_{AT}}+S^2+\frac{1}{T_{AT}^2}}, \tag{14}$$

where $Q(B)_{ts}$ represents a damping of the driver 106 and $T_{AT}$ represents a time constant of the driver 106. Equation (14) represents a natural response of the acoustic transducer. Also, $Q(B)_{ts}$ may be expressed with the following equation:

$$Q(B)_{ts}=\frac{R_m\cdot S_D^2\cdot T_{AT}}{C_{AT}\cdot(Bl_{effective}^2+R_{AS}\cdot R_m\cdot S_D^2)}, \tag{15}$$

where $C_{AT}$ represents compliance of the driver 106 (which also includes compliance of a speaker box if a box is used to enclose any of the described acoustic transducers), B represents the magnetic flux in the air gap 136 and $l_{effective}$ represents an effective length of the moving coil 120 in the magnetic flux in the air gap 136.

It will be understood that for speakers of other designs, such as vented, bandpass or with a passive radiator, a corresponding equation may be used to represent each of the damping function $Q(B)_{ts}$ of the driver 106 and the transfer function G(s,B).

Using Equations (12) to (14), the error signal E may therefore be expressed as:

$$E(s, B) = \frac{S \cdot \frac{1}{Q(B)_{ts} \cdot T_{AT}} + S^2 + \frac{1}{T_{AT}^2}}{S^2 + \frac{s}{Q_{hp} \cdot T_{hp}} + \frac{1}{T_{hp}^2}}, \tag{16}$$

A bilinear transform may be applied to Equation (16) to generate a biquadratic polynomial in the z-domain, as shown as Equation (17) below, so that the error signal E may be simulated in the discrete time domain.

$$E(z) = \frac{a_0 + a_1 \cdot z^{-1} + a_2 \cdot z^{-2}}{b_0 + b_1 \cdot z^{-1} + b_2 \cdot z^{-2}}, \tag{17}$$

where $a_0$ and $b_0$ represent the coefficients for the current iteration, $a_1$ and $b_1$ represent the coefficients for a previous iteration, and $a_2$ and $b_2$ represent the coefficients for an iteration prior to the previous iteration. Some of the coefficients in Equation (17) depend on the magnetic flux B. It will be understood that since the magnetic flux B in the air gap 136 changes with each iteration, the coefficients in Equation (17) need to be determined with each iteration. In some embodiments, the coefficients may be determined from a lookup table or calculated directly from the bilinear transform.

In some other embodiments, the described acoustic transducers may be modeled with a direct numerical method. For example, differential equations may be used iteratively.

In some embodiments, the transfer function block 720 may also account for the effect of inductance $L_m$ of the moving coil 120. This can be important since the moving coil inductance $L_m$ affects the high frequency response of the driver 106 and may also be dependent on the magnetic flux in the magnetic material 112. In one example, the order of Equation (14), and accordingly, the order of Equation (16), may be increased. In another example, a moving coil inductance block may be included before or after the target signal block 710, or after the error signal E(s,B) is determined. The moving coil inductance block may include at least one frequency dependent component corresponding to the moving coil inductance $L_m$ and the magnetic flux in the air gap 136. A transfer function of the moving coil inductance block may be expressed in the s-domain with the following equation:

$$L_{eq}(s, B) = \frac{T(B)_{LR} \cdot S + 1}{T_{Shelf} \cdot S + 1}, \tag{18}$$

where $T_{shelf}$ represents a time constant for an upper corner of a shelf equalization and $T(B)_{LR}$ represents a time constant of the inductance and resistance of the moving coil 120. The inductance and resistance at the moving coil 120 may be expressed as $L_m(B)/R_m$, where the moving coil inductance $L_m$ is a function of the magnetic flux B in the air gap 136.

As described above, a bilinear transform may be applied to Equation (18) to generate a biquadratic polynomial in the z-domain, as shown as Equation (19) below, so that the moving coil inductance signal $L_{eq}(s,B)$ may be simulated in the discrete time domain.

$$L_{eq}(z) = \frac{a_0 + a_1 \cdot z^{-1} + a_2 \cdot z^{-2}}{b_0 + b_1 \cdot z^{-1} + b_2 \cdot z^{-2}}, \tag{19}$$

where $a_0$ and $b_0$ represent the coefficients for a current iteration, $a_1$ and $b_1$ represent the coefficients for a previous iteration, and $a_2$ and $b_2$ represent the coefficients for an iteration prior to the previous iteration. Some of the coefficients in Equation (19) depend on the magnetic flux B. It will be understood that since the magnetic flux B in the air gap 136 changes the moving coil inductance $L_m$ at each iteration, the coefficients in Equation (19) need to be determined with each iteration. In some embodiments, the coefficients may be determined from a lookup table or calculated directly from the bilinear transform. Also, since the moving coil inductance $L_m$ is a function of the magnetic flux B in the air gap 136, the moving coil inductance $L_m$ can also be determined from a lookup table or with the use of a first, second, third, or higher, order polynomial. For example, the moving coil inductance $L_m$, as a function of the magnetic flux B, may be determined using the following equation:

$$L_m(B) = a \cdot B^3 + b \cdot B^2 + c \cdot B + d, \tag{20}$$

Some embodiments of the above described acoustic transducers may be a hybrid acoustic transducer. The hybrid acoustic transducer uses both a permanent magnet and one or more stationary coil 118 to magnetize the magnetic material 112 and air gap 136. It may be desirable to use the hybrid acoustic transducer for increasing the magnetic flux at low levels of the stationary coil current signal $I_s$.

Figure 8:
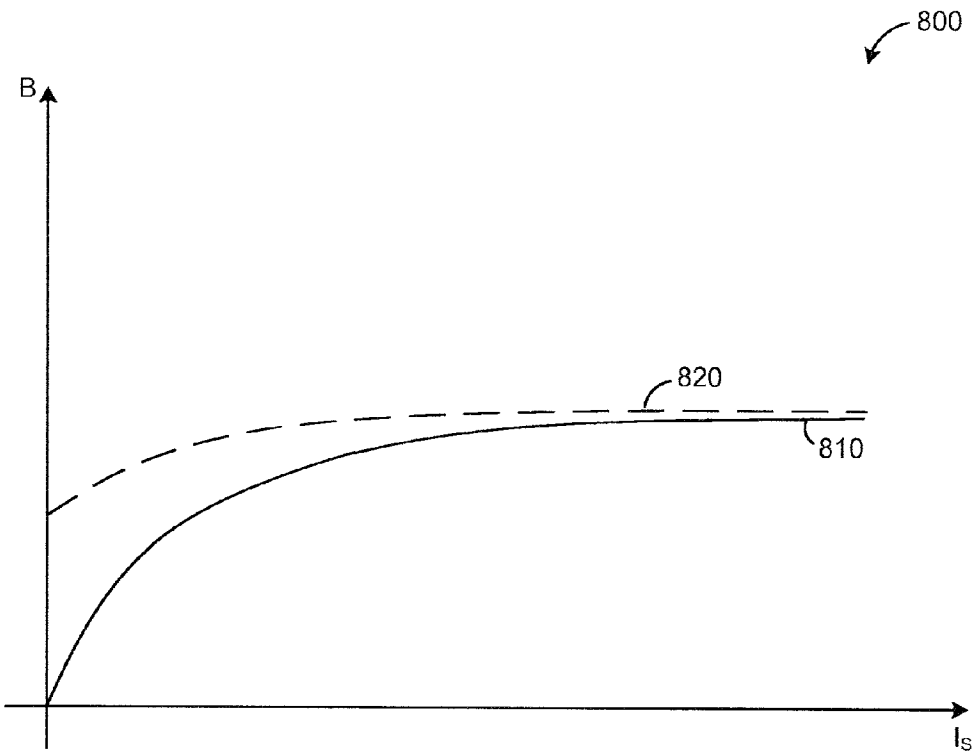
FIG. 8 illustrates magnetic flux curves for different acoustic transducer designs in accordance with an example embodiment.

Reference is now made to FIG. 8, which generally illustrates magnetic flux curves 800 for different acoustic transducer designs. The magnetic flux curves 800 plots the flux density B in the magnetic material 112 versus the stationary coil current signal $I_s$ for different acoustic transducer designs. A curve 810 corresponds to an acoustic transducer that uses stationary coil 118 to magnetize the magnetic material 112, such as any of the above described acoustic transducers, and a curve 820 corresponds to the hybrid acoustic transducer. In comparing curve 810 to curve 820, it can be determined that, for smaller values of the stationary coil current signal $I_s$, the hybrid acoustic transducer is more efficient in generating the magnetic flux in the air gap 136. However, for larger values of the stationary coil current signal $I_s$, there is no significant difference in the generation of the magnetic flux as between any of the above described acoustic transducers and the hybrid acoustic transducer.

For the hybrid acoustic transducer, the stationary coil current signal $I_s$ may be expressed as follows:

$$I_S = \frac{B}{N} \cdot R \cdot A + \frac{H_{magnet} \cdot l_{magnet}}{N}, \tag{21}$$

where B represents a magnetic flux in the air gap 136, N represents a number of turns in the stationary coil 118, R represents a reluctance of a magnetic circuit of the hybrid acoustic transducer (the magnetic circuit includes the permanent magnet, the magnetic material 112 and the air gap 136), A represents a cross-sectional area of the magnetic material 112 and the air gap 136, $H_{magnet}$ represents a magnetomotive force of the permanent magnet and $l_{magnet}$ represents a length of the permanent magnet in a direction of the magnetic flux of the magnet ($B_{magnet}$). The magnetomotive force $H_{magnet}$ for a magnet may generally be expressed as follows:

$$H_{magnet} = \frac{B_{magnet} - B_{remanence}}{\text{Permanence Coefficient}}, \quad (22)$$

where $B_{magnet}$ represents the magnetic flux density of the permanent magnet and $B_{remanence}$ represents a residual inductance of the permanent magnet. The values for $B_{remanence}$ and the permanence coefficient depend on the permanent magnet used in the hybrid acoustic transducer. It will be understood that the values of B and $B_{magnet}$ may be equivalent if the cross-sectional areas of each of the magnetic material 112 and the permanent magnet are equal.

Referring again to FIG. 8, the reluctance R of the magnetic circuit of the hybrid acoustic transducer varies with B since the magnetic flux induced in the magnetic material 112 saturates. The curve 820 may be plotted using any first, second, third or higher order polynomial that adequately fits curve 820. For example, the below expression for the magnetic flux as a function of the stationary coil current signal $I_s$ may be used:

$$B(I_s)=n_1 \cdot I_s^3+n_2 \cdot I_s^2+n_3 \cdot I_s+n_4, \quad (23)$$

where the coefficients $n_1$, $n_2$, $n_3$ and $n_4$ are chosen to fit curve 820. Another equation of a similar form may also be used.

The various embodiments described above are described at a block diagram level and with the use of some discrete elements to illustrate the embodiments. Embodiments of the invention, including those described above, may be implemented in a device providing digital signal processing, or a device providing a combination of analog and digital signal processing.

The present invention has been described here by way of example only. Various modification and variations may be made to these exemplary embodiments without departing from the spirit and scope of the invention, which is limited only by the appended claims.

We claim:

1. A method of operating an acoustic transducer, the method comprising:
- receiving an input audio signal;
- generating a time-varying stationary coil signal in a stationary coil, wherein the time-varying stationary coil signal corresponds to the input audio signal, wherein the stationary coil induces a magnetic flux in a magnetic flux path;
- generating a time-varying moving coil signal in a moving coil, wherein:
  - the moving coil is disposed within the magnetic flux path;
  - the time-varying moving coil signal corresponds to both the time-varying stationary coil signal and a processed version of the input audio signal; and
  - the time-varying moving coil is coupled to a moving diaphragm which moves in response to the time-varying moving coil signal; and
- generating the processed version of the input audio signal in response to a magnetic flux value corresponding to the time-varying stationary coil signal,
- wherein the magnetic flux value is determined by a method selected from the group consisting of:
- looking up the magnetic flux value in a lookup table; and
- determining the magnetic flux value using a polynomial.

2. The method of claim 1, further comprising:
- providing a target input audio signal in response to the input audio signal; and
- generating an updated processed version of the input audio signal, wherein the updated processed version of the input audio signal corresponds to the magnetic flux value and the target input audio signal.

3. The method of claim 2, wherein generating the updated processed version of the input audio signal further comprises:
- determining the updated processed version of the input audio signal based on a transfer function and the target input audio signal, wherein the transfer function corresponds to the magnetic flux value.

4. The method of claim 1 wherein the processed version of the input audio signal is iteratively updated in response to the magnetic flux value.

5. The method of claim 1, wherein generating the time-varying stationary coil signal further comprises:
- generating a stationary coil control signal corresponding to the input audio signal; and
- generating the time-varying stationary coil signal corresponding to the stationary coil control signal.

6. The method of claim 5, wherein generating the time-varying moving coil signal further comprises:
- dividing the processed version of the input audio signal by the stationary coil control signal.

7. The method of claim 1 wherein the acoustic transducer is a hybrid acoustic transducer including a permanent magnet that induces magnetic flux in the magnetic flux path, and wherein the time-varying stationary coil signal corresponds to both the magnetic flux induced by the permanent magnet and the input audio signal.

8. An acoustic transducer comprising:
- an audio input terminal for receiving an input audio signal;
- a driver having:
  - a moving diaphragm;
  - a magnetic material having an air gap;
  - a stationary coil for inducing magnetic flux in the magnetic material and the air gap;
  - a moving coil coupled to the diaphragm wherein the moving coil is disposed at least partially within the air gap; and
  - a control system adapted to:
    - produce a time-varying stationary coil signal in the stationary coil, wherein the time-varying stationary coil signal corresponds to the input audio signal;
    - produce a time-varying moving coil signal in the moving coil, wherein:
      - the time-varying moving coil signal corresponds to both the time-varying stationary coil signal and a processed version of the input audio signal; and
      - the time-varying moving coil is coupled to the moving diaphragm which moves in response to the time-varying moving coil signal; and
- generate the processed version of the input audio signal in response to a magnetic flux value corresponding to the time-varying stationary coil signal,
- wherein the magnetic flux value is determined by a method selected from the group consisting of:
- looking up the magnetic flux value in a lookup table; and
- determining the magnetic flux value using a polynomial.

9. The acoustic transducer of claim 8, wherein the control system is further adapted to:
- provide a target input audio signal in response to the input audio signal; and
- generate an updated processed version of the input audio signal, wherein the updated processed version of the input audio signal corresponds to the magnetic flux value and the target input audio signal.

10. The acoustic transducer of claim 9, wherein the control system is further adapted to:

iteratively update the processed version of the input audio signal based on a transfer function and the target input audio signal, wherein the transfer function corresponds to the magnetic flux value.

11. The acoustic transducer of claim 8, wherein the control system is further adapted to:

generate a stationary coil control signal corresponding to the input audio signal; and generate the time-varying stationary coil signal corresponding to the stationary coil control signal.

12. The acoustic transducer of claim 11, wherein the control system is further adapted to:

divide the processed version of the input audio signal by the stationary coil control signal.

13. The acoustic transducer of claim 8 further comprising a permanent magnet for inducing magnetic flux in the air gap, wherein the control system is adapted to produce the time-varying stationary coil signal corresponding to both the input audio signal and the magnetic flux induced by the permanent magnet in the air gap.

14. A method of operating an acoustic transducer, the method comprising:

receiving an input audio signal;

generating a time-varying moving coil signal in a moving coil, wherein:

the moving coil is disposed within a magnetic flux path;

the time-varying moving coil signal corresponds to at least a processed version of the input audio signal; and the moving coil is coupled to a moving diaphragm which moves in response to the time-varying moving coil signal;

generating a feedback signal for updating the time-varying moving coil signal;

applying a time-varying stationary coil signal in a stationary coil, wherein the stationary coil induces a magnetic flux in the magnetic flux path, and wherein the time-varying stationary coil signal corresponds to the feedback signal; and updating the time-varying moving coil signal in response to the feedback signal, wherein generating the time-varying moving coil signal comprises:

dividing the processed version of the input audio signal by the feedback signal.

15. The method of claim 14, wherein generating the feedback signal for updating the time-varying moving coil signal further comprises:

determining a stationary coil loss and a moving coil loss, the stationary coil loss corresponds to a loss at the stationary coil and the moving coil loss corresponds to a loss at the moving coil;

determining a power balancing signal, wherein the power balancing signal corresponds to a difference between the stationary coil loss and the moving coil loss; and determining the feedback signal based on the power balancing signal.

16. The method of claim 14, wherein updating the time-varying moving coil signal further comprises:

providing a target input audio signal corresponding to the input audio signal; and generating an updated processed version of the input audio signal based on the target input audio signal.

17. The method of claim 16, wherein generating an updated processed version of the input audio signal further comprises:

determining a feedback magnetic flux value corresponding to the feedback signal; and iteratively updating the processed version of the input audio signal based on a transfer function and the target input audio signal, wherein the transfer function corresponds to the feedback magnetic flux value.

18. The method of claim 17, wherein the feedback magnetic flux value is determined by a method selected from the group consisting of:

looking up the magnetic flux value in a lookup table; and determining the magnetic flux value using a polynomial.

19. The method of claim 14 the acoustic transducer is a hybrid acoustic transducer including a permanent magnet that induces magnetic flux in the magnetic flux path, and wherein the time-varying stationary coil signal corresponds to both the magnetic flux induced by the permanent magnet and the input audio signal.

20. An acoustic transducer comprising:

an audio input terminal for receiving an input audio signal;

a driver having:

a moving diaphragm;

a magnetic material having an air gap;

a stationary coil for inducing magnetic flux in the magnetic material and the air gap;

a moving coil coupled to the diaphragm wherein the moving coil is disposed at least partially within the air gap;

a control system adapted to:

generate a time-varying moving coil signal in the moving coil, wherein:

the time-varying moving coil signal corresponds to at least a processed version of the input audio signal; and the moving coil is coupled to the moving diaphragm which moves in response to the time-varying moving coil signal;

generate a feedback signal for updating the time-varying moving coil signal;

apply a time-varying stationary coil signal in the stationary coil, wherein the time-varying stationary coil signal corresponds to the feedback signal; and update the time-varying moving coil signal in response to the feedback signal, and a permanent magnet for inducing magnetic flux in the air gap, wherein the control system is adapted to produce the time-varying stationary coil signal corresponding to both the input audio signal and the magnetic flux induced by the permanent magnet in the air gap.

21. The acoustic transducer of claim 20, wherein the control system is further adapted to:

determine a stationary coil loss and a moving coil loss, wherein the stationary coil loss corresponds to a loss at the stationary coil and the moving coil loss corresponds to a loss at the moving coil;

determine a power balancing signal, wherein the power balancing signal corresponds to a difference between the stationary coil loss and the moving coil loss; and determine the feedback signal based on the power balancing signal.

22. The acoustic transducer of claim 20, wherein the control system is further adapted to: divide the processed version of the input audio signal by the feedback signal.

23. The acoustic transducer of claim 20, wherein the control system is further adapted to:

provide a target input audio signal corresponding to the input audio signal; and generate an updated processed version of the input audio signal based on the target input audio signal.

24. The acoustic transducer of claim 23, wherein the control system is further adapted to:

determine a feedback magnetic flux value corresponding to the feedback signal; and iteratively update the updated processed version of the input audio signal based on a transfer function and the target input audio signal, wherein the transfer function corresponds to the feedback magnetic flux value.

25. The acoustic transducer of claim 24, wherein the feedback magnetic flux value is determined by a method selected from the group consisting of:

looking up the magnetic flux value in a lookup table; and determining the magnetic flux value using a polynomial.

26. An acoustic transducer comprising:

an audio input terminal for receiving an input audio signal;

a driver having:

a moving diaphragm;

a magnetic material having an air gap;

a stationary coil for inducing magnetic flux in the magnetic material and the air gap;

a moving coil coupled to the diaphragm wherein the moving coil is disposed at least partially within the air gap; and a control system adapted to:

produce a time-varying stationary coil signal in the stationary coil, wherein the time-varying stationary coil signal corresponds to the input audio signal;

produce a time-varying moving coil signal in the moving coil, wherein:

the time-varying moving coil signal corresponds to both the time-varying stationary coil signal and a processed version of the input audio signal; and the time-varying moving coil is coupled to the moving diaphragm which moves in response to the time-varying moving coil signal; and generate the processed version of the input audio signal in response to a magnetic flux value corresponding to the time-varying stationary coil signal, wherein the magnetic flux value is determined by one of:

a lookup table including the magnetic flux value; and a polynomial that provides the magnetic flux value.

* * * * *